US009718247B2

(12) United States Patent
Lin

(10) Patent No.: US 9,718,247 B2
(45) Date of Patent: Aug. 1, 2017

(54) METHOD FOR FABRICATING BUBBLER

(71) Applicant: Pei-Ti Lin, Taipei (TW)

(72) Inventor: Pei-Ti Lin, Taipei (TW)

( * ) Notice: Subject to any disclaimer, the term of this patent is extended or adjusted under 35 U.S.C. 154(b) by 313 days.

(21) Appl. No.: 14/676,904

(22) Filed: Apr. 2, 2015

(65) Prior Publication Data

US 2016/0288443 A1 Oct. 6, 2016

(51) Int. Cl.

| | |
|---|---|
| ***B31B 1/74*** | (2006.01) |
| ***D21H 19/70*** | (2006.01) |
| ***D21H 19/84*** | (2006.01) |
| ***D21H 25/00*** | (2006.01) |
| ***D21H 27/10*** | (2006.01) |
| ***D21H 19/22*** | (2006.01) |
| ***D21H 19/26*** | (2006.01) |

(52) U.S. Cl.

CPC ..... *B31B 1/74* (2013.01); *D21H 19/22* (2013.01); *D21H 19/26* (2013.01); *D21H 19/70* (2013.01); *D21H 19/84* (2013.01); *D21H 25/005* (2013.01); *D21H 27/10* (2013.01); *B31B 2217/0023* (2013.01); *B31B 2217/062* (2013.01); *B31B 2217/082* (2013.01)

(58) Field of Classification Search

CPC ..... D21H 19/66

See application file for complete search history.

(56) References Cited

U.S. PATENT DOCUMENTS 3,970,219 A * 7/1976 Spitzer ..... B65D 83/14 222/1

2007/0048848 A1* 3/2007 Sears ..... C12M 21/12 435/134

* cited by examiner

*Primary Examiner* — Ryan Ochylski

(74) *Attorney, Agent, or Firm* — Jackson IPG PLLC; Demian K. Jackson

(57) ABSTRACT

A method for fabricating a bubbler is disclosed, which is performed by laminating a polypropylene (PP), PE, CPET film onto a paper material surface to form a PP, PE, CPET film, and then screen printing or coating a hydrophilic polyurethane (PU) material onto another surface of the paper material to form a hydrophilic PU foaming material, then color printing a print material onto the hydrophilic foaming film to form a pattern layer, trimming the paper material to form a paper plate having a desired range, and forming the paper plate as an utensil, and enabling the hydrophilic PU foaming film to form a three dimensional pattern area on a surface of the utensil by being heated and thus foaming with a heating temperature presenting when the utensil is formed, whereby a three dimensional pattern area may be directly formed onto a surface of a utensil.

5 Claims, 6 Drawing Sheets

METHOD FOR FABRICATING BUBBLER

FIELD OF THE INVENTION

The present invention relates to a method for fabricating a bubbler and particularly to a method for fabricating a bubbler so that a three dimensional pattern area may be directly formed onto a surface of a utensil by using a hydrophilic PU foaming film without requiring a binding agent, so as to increase a fabricating speed and reduce a fabricating cost, and further have an increased thickness, a better hydrolysis proofing, a better scrape proofing, and a better heat isolation.

DESCRIPTION OF THE RELATED ART

In fabricating a foaming material heat-isolated container, a PP or PE or PS material is coated on a surface of the container as a foaming material, and then the container and the foaming material are concurrently basked to form a foaming layer on the container surface with the PP or PE material.

However, the PE, PP or PS material being completely a plastic material usually has a poor foaming result when being baked. The PE material may be apt to fall off when being baked up to 120° C., and the PP material may be damaged. In this manner, when the PE and PP foaming material forms the foaming layer, the foaming layer may usually have the shortcomings of a small thickness, a poor heat isolation effect, etc. Furthermore, the baked container may be filled with air holes or irregular surface topology, resulting in the demerits of vague pattern or color or difficult printing.

Taiwan patent 1271364 disclosed an improved method for fabricating a paper made container with a heat isolation surface layer, where a composite coating material is formed by agitating and thus mixing a liquid binding agent (polyvinylacetate ethylene or polyvinylacetate) and thermally foaming particle powders (thermally copolymer with a low boiling point solvent covered inside). This liquid coating material is applied onto a surface of the paper made container and the container is then subject to a temperature of 100° C. to 140° C. The thermally foaming particle powders are provided to foam and the liquid binding agent is adhered to the surface of the paper made container, forming a foaming layer on the surface. In addition, the composite coating material in the patent is doped with the liquid binding agent of polyvinylacetate ethylene or polyvinylacetate having a concentration of 5%~20%. However, the foaming layer is apt to fall off whenever encountering water owing to its material characteristics. Therefore, the conventional foaming material does not meet with the requirement for an actual use.

SUMMARY OF THE INVENTION

It is a main objet of the present invention to provide a method for fabricating a bubbler to overcome the shortcoming encountered in the prior art, so that a three dimensional pattern area may be directly formed onto a surface of a utensil by using a hydrophilic PU foaming film without requiring a binding agent, so as to increase a fabricating speed and reduce a fabricating cost, and further have an increased thickness, a better hydrolysis proofing, a better scrape proofing, and a better heat isolation.

According to the present invention, the method for fabricating the bubbler comprises steps of (a) preparing a paper material, applying an extrusion coating on a first surface of the paper material laminating a polypropylene (PP) material onto the first surface of the paper material to form a PP film; (b) subjecting a second surface of the paper material to a screen printing process, screen printing a hydrophilic polyurethane (PU) foaming material onto the second surface of the paper material to form a hydrophilic PU foaming film; (c) color printing a print material onto the hydrophilic foaming film to form a pattern layer; (d) trimming the paper material to form a paper plate having a desired range; and (e) forming the paper plate as an utensil, and enabling the hydrophilic PU foaming film to form a three dimensional pattern area on a surface of the utensil by being heated and thus foaming with a heating temperature presenting when the utensil is formed.

In an embodiment, the utensil is selected from a group consisting of a paper made cup, a paper made tray, and a paper made dinner pail.

In an embodiment, the color printing is in step (c) selected from a group consisting of an ultraviolet (UV) printing, an off-set printing, or a general ink printing.

In an embodiment, step (e) is performed under the temperature of from 250 to 350° C. for less than two seconds to enable the hydrophilic PU foaming film to completely foam.

In an embodiment, the hydrophilic PU foaming film becomes to have a thickness of at least six times after being heated within the short time period to form the three dimensional pattern area.

BRIEF DESCRIPTIONS OF THE DRAWINGS

The present invention will be better understood from the following detailed descriptions of the preferred embodiments according to the present invention, taken in conjunction with the accompanying drawings, in which.

DESCRIPTION OF THE PREFERRED EMBODIMENTS

Referring to FIG. 1 through FIG. 6, a schematic diagram of an extrusion coating according to the present invention, a schematic diagram of a screen printing according to the present invention; a schematic diagram of a color printing according to the present invention, a schematic diagram of a paper material trim according to the present invention, a schematic diagram of a concurrent forming and foaming according to the present invention, and a schematic diagram of a cross sectional view of a bubbler according to an embodiment of the present invention are shown, respectively.

Figure 1:
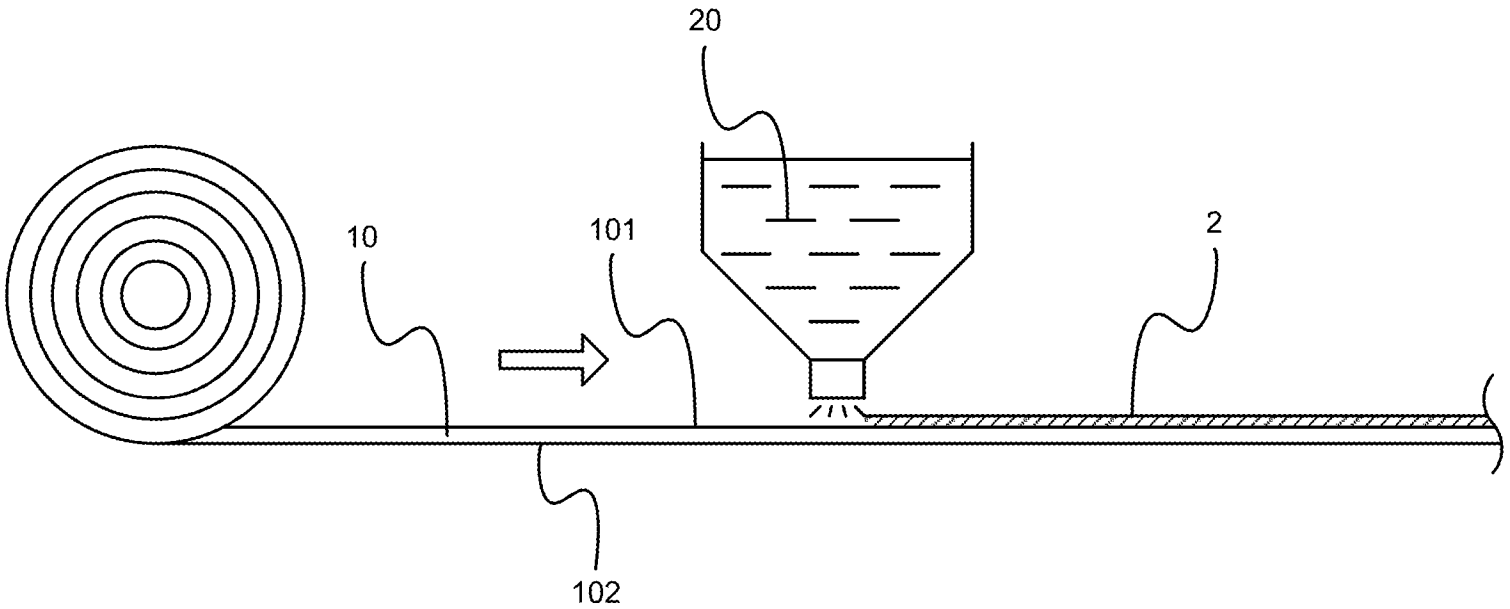
FIG. 1 is a schematic diagram of an extrusion coating according to the present invention.
Figure 2:
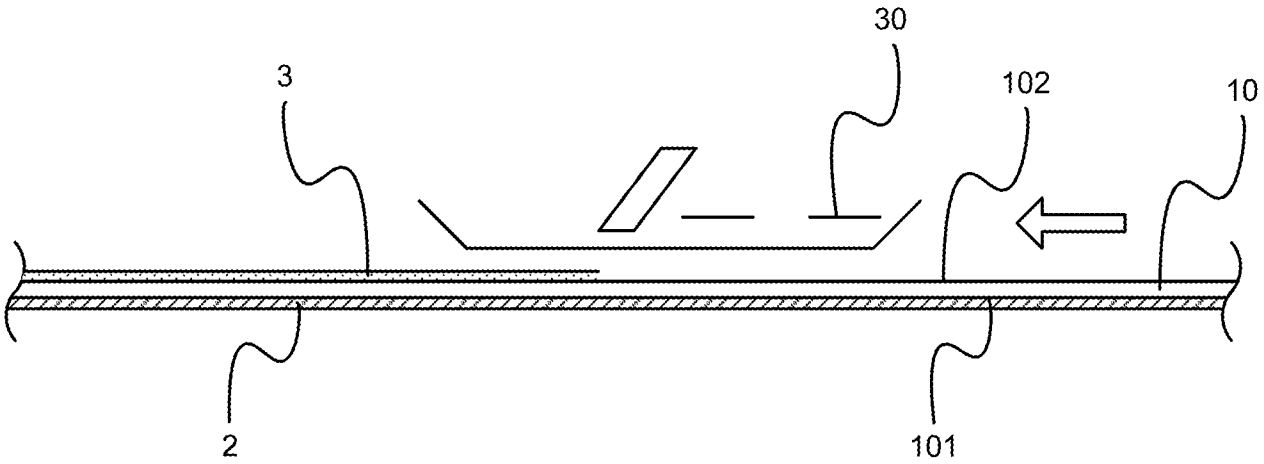
FIG. 2 is a schematic diagram of a screen printing according to the present invention.
Figure 3:
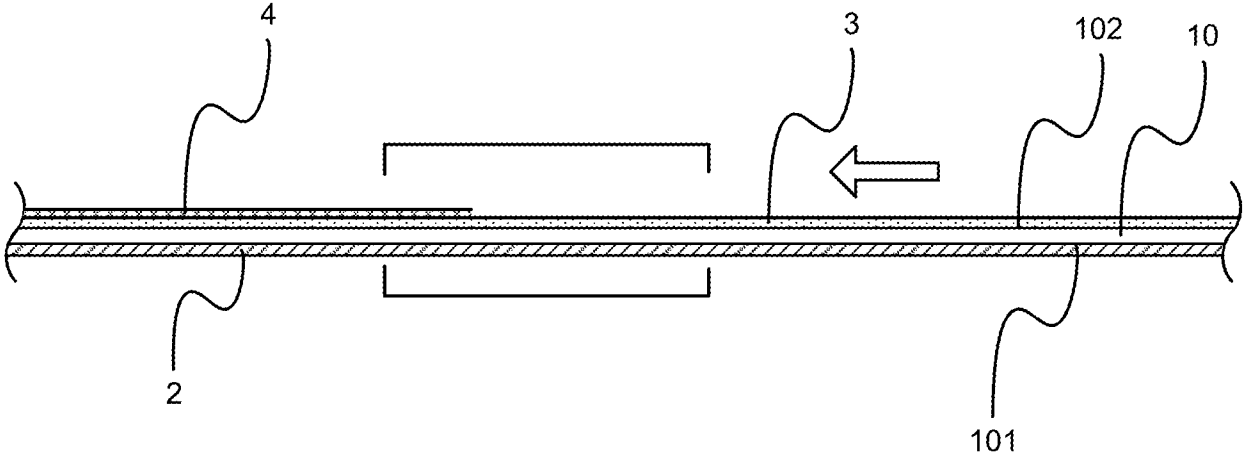
FIG. 3 is a schematic diagram of a color printing according to the present invention.

At first, a paper material 10 is prepared, an extrusion coating process is applied onto a first surface 101 of the paper material 10, a polypropylene (PP) material is laminated onto the first surface 101 of the paper material 10 to form a PP, PE or CPET film 2, as is shown in FIG. 1.

Next, a second surface 102 of the paper material 10 is subject a screen printing process, a hydrophilic polyurethane (PU) foaming material is screen printed onto the second surface 102 of the paper material 10 to form a hydrophilic PU foaming film 3.

Thereafter, a print material is color printed onto the hydrophilic foaming film 3 to form a pattern layer 4 by using a ultraviolet (UV) printing, an off-set printing, or a general ink printing.

Figure 4:
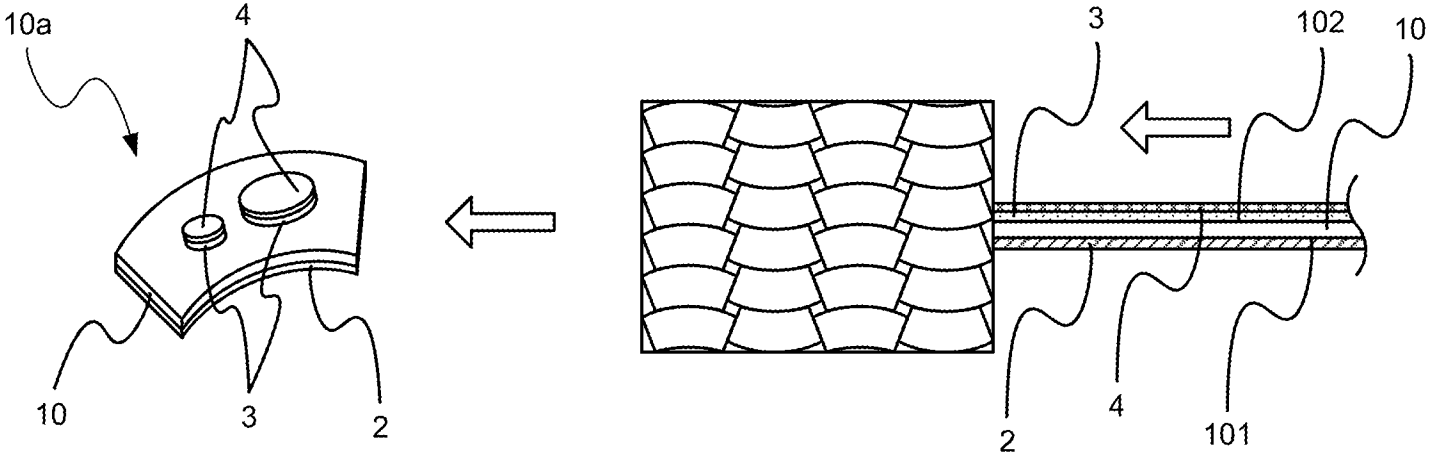
FIG. 4 is a schematic diagram of a paper material trim according to the present invention.

Subsequently, the paper material is trimmed to form a paper plate 10*a* having a desired range, as is shown in FIG. 4.

Figure 5:
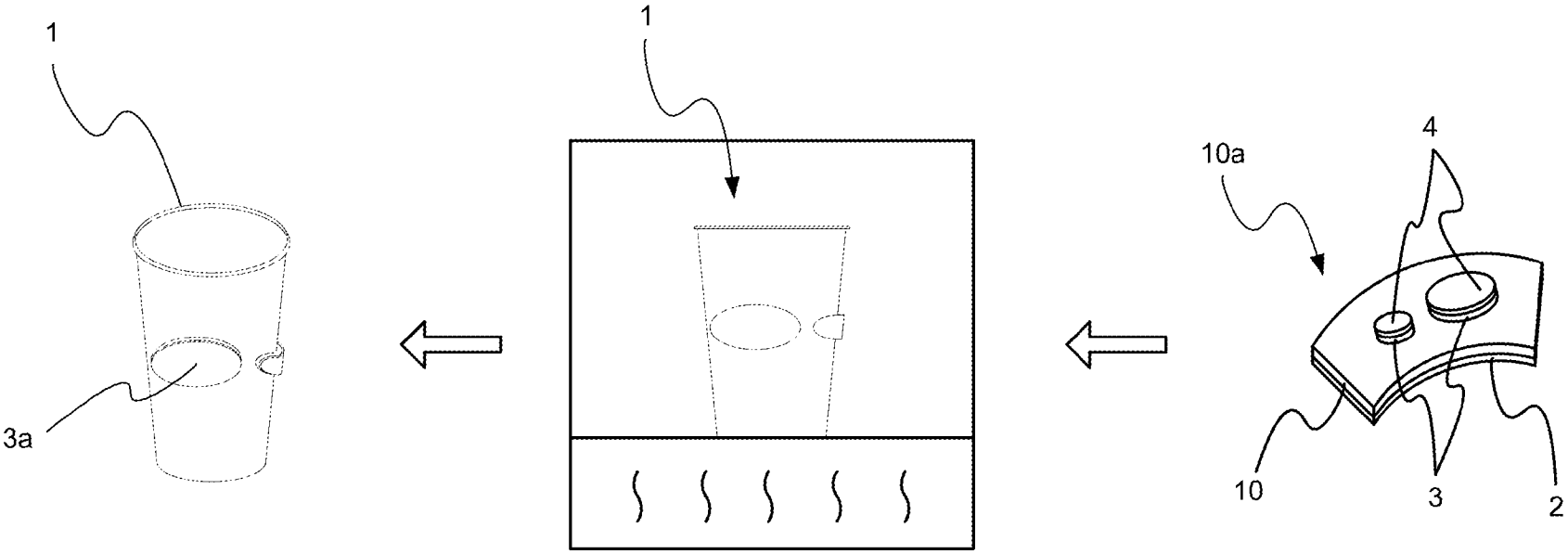
FIG. 5 is a schematic diagram of a concurrent forming and foaming according to the present invention.

Then, the paper plate 10*a* is formed as an utensil 1, and the hydrophilic PU foaming film 3 is enabled to form a three dimensional pattern area on a surface of the utensil by being heated and thus foaming with a heating temperature presenting when the utensil 1 is formed, where the temperature is provided from 250 to 350° C. for less than two seconds to enable the hydrophilic PU foaming film 3 to completely foam, thereby forming a three dimensional pattern area 3*a* on a surface of the utensil 1, as is shown FIG. 5. At this time, the hydrophilic PU foaming film 3 becomes to have a thickness of at least six times after being heated within the short time period to form the three dimensional pattern area 3*a*.

Figure 6:
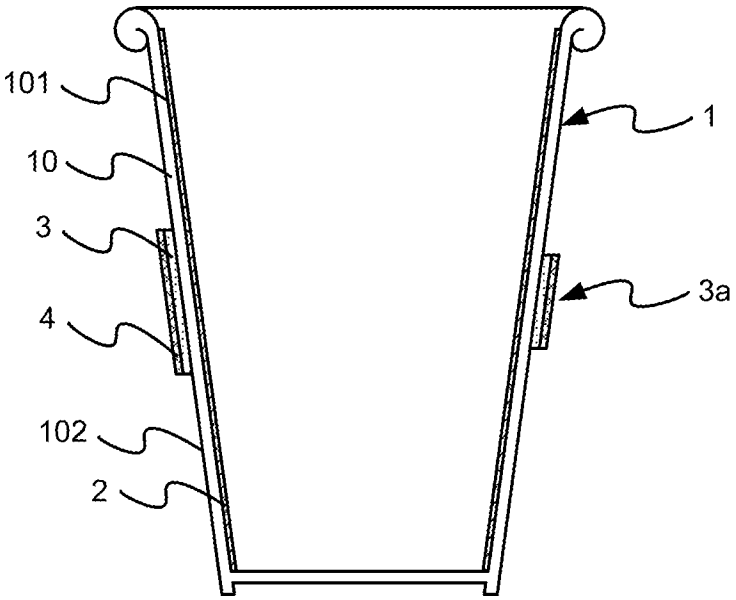
FIG. 6 is a schematic diagram of a cross sectional view of a bubbler according to an embodiment of the present invention.

As such, the three dimensional pattern area 3*a* may be directly formed onto the surface of the utensil immediately by using the hydrophilic PU foaming film, without requiring an additional binding agent. Furthermore, such formed bubbler has the efficacies of an increased thickness, a better hydrolysis proofing, a better scrape proofing, and a better heat isolation. The utensil 1 may be a paper made cup, a paper made tray, or a paper made dinner pail, as is shown in FIG. 6 and the paper made cup in this embodiment as an example. As such, a novel method for fabricating a bubbler is completely provided.

In summary, the method for fabricating a bubbler of the present invention may effectively overcome the shortcoming encountered in the prior art, in which the three dimensional pattern area may be directly formed onto the surface of the utensil by using the hydrophilic PU foaming film without requiring the binding agent, so as to increase a fabricating speed and reduce a fabricating cost, and further have an increased thickness, a better hydrolysis proofing, a better scrape proofing, and a better heat isolation.

From all these views, the present invention may be deemed as being more effective, practical, useful for the consumer's demand, and thus may meet with the requirements for a patent.

The above described is merely examples and preferred embodiments of the present invention, and not exemplified to intend to limit the present invention. Any modifications and changes without departing from the scope of the spirit of the present invention are deemed as within the scope of the present invention. The scope of the present invention is to be interpreted with the scope as defined in the claims.

What is claimed is:

1. A method for fabricating a bubbler, comprising steps of:

(a) preparing a paper material, applying an extrusion coating on a first surface of the paper material laminating a polypropylene (PP) material onto the first surface of the paper material to form a PP film;

(b) subjecting a second surface of the paper material to a screen printing process, screen printing a hydrophilic polyurethane (PU) foaming material onto the second surface of the paper material to form a hydrophilic PU foaming film;

(c) color printing a print material onto the hydrophilic foaming film to form a pattern layer;

(d) trimming the paper material to form a paper plate having a desired range; and (e) forming the paper plate as an utensil, and enabling the hydrophilic PU foaming film to form a three dimensional pattern area on a surface of the utensil by being heated and thus foaming with a heating temperature presenting when the utensil is formed.

2. The method for fabricating the bubbler as claimed in claim 1, wherein the utensil is selected from a group consisting of a paper made cup, a paper made tray, and a paper made dinner pail.

3. The method for fabricating the bubbler as claimed in claim 1, wherein the color printing in step (c) is selected from a group consisting of a ultraviolet (UV) printing, an off-set printing, or a general ink printing.

4. The method for fabricating the bubbler as claimed in claim 1, wherein step (e) is performed under the temperature of from 250 to 350° C. for less than two seconds to enable the hydrophilic PU foaming film to completely foam.

5. The method for fabricating the bubbler as claimed in claim 1, wherein the hydrophilic PU foaming film becomes to have a thickness of at least six times after being heated within the short time period to form the three dimensional pattern area.

* * * * *